United States Patent [19]

Linker

[11] 3,977,590

[45] Aug. 31, 1976

[54] COOLED ROLLER

[75] Inventor: Elliot C. Linker, Irvine, Calif.

[73] Assignee: Electronic Engineering Company of California, Santa Ana, Calif.

[22] Filed: Mar. 19, 1975

[21] Appl. No.: 560,003

[52] U.S. Cl. ..... 226/190; 165/89

[51] Int. Cl.[2] ..... B65H 17/20

[58] Field of Search ..... 226/190, 194; 29/114, 29/127; 165/89; 34/124, 119, 125

[56] References Cited

UNITED STATES PATENTS

| | | | |
|---|---|---|---|
| 1,816,307 | 7/1931 | Von Reis | 165/89 |
| 2,908,486 | 10/1959 | Thornburg | 165/89 |
| 3,548,929 | 12/1970 | Gross | 165/89 |
| 3,667,542 | 6/1972 | Parkes | 165/89 |
| 3,746,233 | 7/1973 | Bauer | 226/194 |
| 3,752,227 | 8/1973 | Bulson | 165/89 |

*Primary Examiner*—Richard A. Schacher
*Attorney, Agent, or Firm*—Harry R. Lubcke

[57] ABSTRACT

A roller for operation in a gaseous environment, perhaps containing solid particles; the roller requiring cooling. A central axial cylindrical aperture surrounding a shaft upon which the roller rotates has a continuous helical groove that extends the full length of the aperture. Upon rapid rotation gas traverses the groove, cooling the roller and removing any solid particles otherwise trapped between the aperture and the shaft.

10 Claims, 3 Drawing Figures

COOLED ROLLER

BACKGROUND OF THE INVENTION

This invention pertains to rollers, as for conveying tape, and the internal structure thereof.

The art has long required rotative rollers for defining a path for filamentary material; including paper tape, magnetic tape, and motion picture film.

At slow speeds of traverse and continuous motion of the tape a roller for the same may fulfill its function without being of critial design.

For modern tape-handling machines, having a rapid tape speed, as 500 to 2,000 centimeters per second, with frequent start-stop accelerations of the order of 20,000 cm per second per second, all elements of the dynamic chain become critical in design.

The mass of the roller adds undesirable inertia during the start-stop epochs. This is particularly true where axes of motion other than purely rotational are involved. Such axes are involved when the roller is mounted on a takeup arm.

Certain designs, such as those employing small ball bearings for journaling the roller upon its central shaft, have been both heavy and expensive. Another design, employing a very hard filled-type plastic, was found to audibly "squeal" at such a sound level after a few hours use that the roller could not be tolerated in commercial equipment manufactured for the competitive marketplace. Even specific alteration of the composition of the plastic to remove this disturbance was unsuccessful.

In the prior art literature, a roller coactive with a specialized reel for overcoming the propensity of Mylar plastic tape to straighten to a linear configuration rather than to be reeled has been fabricated in two halves. Each half has an inwardly beveled outer flange that spreads the sides of the reel to allow the tape to exit the reel. No aspects of cooling or freeing the roller of foreign material are disclosed.

The simple oil-conveying groove in known journals for machine shafts is well known. However, such grooves are restricted to the center of the journal, since the object is to distribute oil around the circumference of the journal, but not to provide a ready avenue of escape for the oil from the bearing. Such escape takes place slowly through the relatively tight fit of the shaft to the journal.

In deep-well in-well water pumps a helical groove extending the whole length of a stationary journal has been used for lubricating the journal by the flow of water through the groove when the shaft is rotating. This flow also removes sand or other foreign material found in well environments. The same type of journal may be used for the long shaft when the pump is downwell and the driving motor is at the surface.

SUMMARY OF THE INVENTION

A roller for use in a gaseous environment is provided with a helical groove within a central axial aperture for the complete axial length thereof. This provides a passage between the body of the roller and the stationary shaft upon which it turns.

The flow of gas through the passage during rapid rotation of the roller is effective in cooling it under conditions of operation that otherwise cause heating to the extent of irreversibly distorting the form of the roller, thereby causing it to adhere to the shaft and preventing rotation thereof.

The passage is also effective in removing small, if not microscopic, particles of foreign material from the roller-shaft interface, with the flow of ambient gas through the groove. This prevents a somewhat unobvious discrepancy; audio "squealing."

DESCRIPTION OF THE PREFERRED EMBODIMENTS

Figure 2:
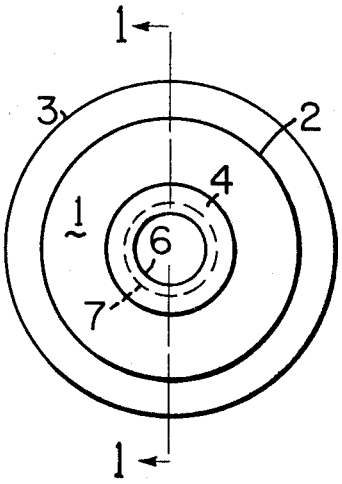
FIG. 2 is an end elevation of the roller of FIG. 1.
Figure 1:
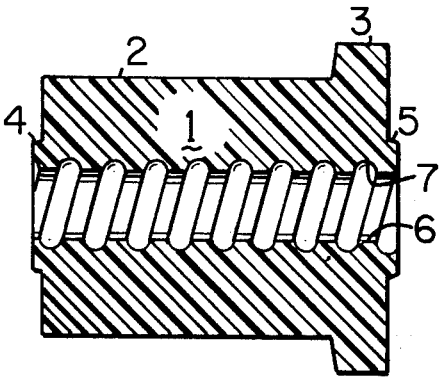
FIG. 1 is a sectional side elevation of the elemental roller along a diametrical section line 1—1 of FIG. 2.

In FIG. 1 numeral 1 indicates the body of the roller. It may be fabricated of a relatively light-weight thermoplastic, such as Delrin 100. It may be made in one operation on a screw machine (lathe). The lightness in weight reduces the inertia over typical prior art rollers. The structure and mode of fabrication reduces the cost of a pair of bodies 1 forming a complete roller to the range of from about one-twelfth to one-twentieth the cost of prior art whole rollers.

The outer shape of the roller is not critical to the objectives of this invention, but may consist of main cylindrical portion 2, a larger diameter flange 3, and minor hubs 4 and 5. The latter relieve either end of the roller from any stationary object, as 11, should the roller be butted against the same.

Figure 3:
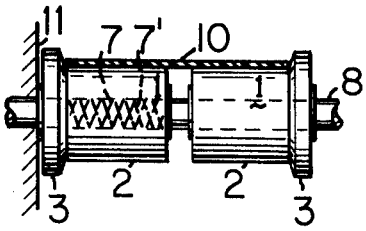
FIG. 3 is an assembled elevation view of two elemental rollers according to FIG. 1, including a shaft and a tape strip conveyed by the roller assembly.

Central axial cylindrical aperture 6 is the means by which the roller is journaled upon axle 8, shown in FIG. 3. The aperture has a helical groove 7 disposed throughout its length. The groove is shown having rounded bottoms, with about half of the inner surface of the aperture being relieved. The shape of the groove may alternately be of triangular cross-section, and it may occupy 60% of the inner surface of the aperture. In the screw machine mode of manufacture the groove may be formed by means of a tap, such as is normally used for cutting internal threads.

In general, the outer configuration of the roller may omit flange 3 and may have any shape required by the application intended.

FIG. 3 shows an application manifesting the advantages previously stated. Two half-rollers 1 are assembled upon shaft 8 in a mirror-image configuration by merely slipping them on the shaft from an end. The diameter of the shaft is such as to provide a close dry running fit.

A paper-base material tape, such as is used for punched tape readers for an example, is shown in section at 10. It normally runs over the roller with any degree of wrap, say from 60° to 180°. It normally has a width, as shown, such that the two halves of the roller are separated by at least a slight distance. This arrangement allows operation with an inadvertently bent shaft, if the bend is at the middle thereof.

A taper is not required upon the outer cylindrical surface 2, but such may be provided if there is any reason for the same.

The helical direction of groove 7 may be right-hand or left-hand. At high rotational speeds there may be a tendency for axial translation of the rollers along the shaft corresponding to the direction of the groove. By employing opposite-hand grooves the halves would have a tendency to come together or move apart. This tendency can be employed to attain secondary objectives.

Also, each roller half may have both right and left-hand grooves, as 7 and 7′ in FIG. 3. These may each be of restricted width and with a double or triple thread pitch lead, so that enough of the inner surface of the central aperture remains to equal approximately 40 %. Such crossed-groove rollers do not have a tendency to axially translate.

The rollers may be made in any size, but one application employed a diameter 2 of 1.3 cm and a length of 1.6 cm, with the diameter of the center aperture being 3 mm and the groove depth being 1 mm.

In practice the gaseous environment is typically air. Such an environment may contain dust particles from various sources. It was found that when any rollers were operated in close proximity to paper-base tape as employed widely for punched paper tape purposes the rollers were exposed to many very small bits of the tape that were abraided from it. Principally these particles would wedge between the central aperture and the shaft, normally imbedding in the surface of the aperture, and soon causing the squealing noise that has been mentioned. This was of the nature of a dry binding bearing.

Additionally, the particles tended to abraid the shaft. The arrangements of the prior art were wholly unsatisfactory; the structure of this invention was wholly satisfactory.

The cooling process occurs because of an internal windage effect through the groove. It is effective approximately proportional to the speed of rotation of the roller, particularly at rotation at 500 revolutions per minute and above.

An alternate plastic material for forming the roller is the copolymer acetal. This is available from the Celanese Company under the name of Celcon.

I claim:

1. A rotatable roller assembly for operation in a gaseous environment, comprising;

a. a body (1), having a cylindrical surface (2), b. a central axial cylindrical aperture (6) within said body, c. a shaft (8) journaled within said aperture, and d. a continuous helical groove (7) in said body in the surface of said aperture and extending the full length of said aperture, whereby ambient gas may traverse said groove when said roller is rotated about said shaft (8).

2. The roller of claim 1, in which;

a. the roller is formed of two independently rotatable halves, each of which are axially substantially mirror images of each other.

3. The roller of claim 2, in which;

a. each half-roller has a flange (3), and b. the half-rollers are disposed upon a shaft (8), to locate a flange at each end of the whole roller assembly.

4. The roller of claim 1, in which;

a. said roller is durable at high velocities by fabrication of the light-weight thermoplastic acetal.

5. The roller of claim 1, in which;

a. the continuous helical groove (7) is in the form of a single internal thread.

6. The roller of claim 1, in which;

a. the continuous helical groove is formed in two opposite directions (7 & 7′), the groove in each direction extending the full length of the aperture (6).

7. The roller of claim 1, in which;

a. the continuous helical groove (7) is formed having a width approximately equal to the remaining inner surface of the central aperture (6).

8. The roller of claim 1, in which;

a. the gas traversing said groove has a lower temperature than the temperature of said roller, whereby the roller is cooled.

9. The roller of claim 1, in which;

a. the gaseous environment includes deleterious foreign particles that are small with respect to the cross-section of said groove (7), whereby said foreign particles are removed from said axial cylindrical aperture (6) by the flow of gas within said groove.

10. The roller of claim 1, which additionally includes;

a. a minor hub (5) at an end of said roller to relieve the same from contact with an adjacent stationary object (11).

* * * * *